US012196508B2

(12) United States Patent
Chiappa

(10) Patent No.: US 12,196,508 B2
(45) Date of Patent: Jan. 14, 2025

(54) SINGLE-SHOT RIFLE

(71) Applicant: ERRESSE S.r.l., Brescia (IT)

(72) Inventor: Rino Chiappa, Brescia (IT)

(73) Assignee: ERRESSE S.r.l., Brescia (IT)

( * ) Notice: Subject to any disclaimer, the term of this patent is extended or adjusted under 35 U.S.C. 154(b) by 0 days.

(21) Appl. No.: 18/225,238

(22) Filed: Jul. 24, 2023

(65) Prior Publication Data

US 2024/0044597 A1 Feb. 8, 2024

(30) Foreign Application Priority Data

Aug. 3, 2022 (IT) ..... 102022000016539

(51) Int. Cl.
*F41A 11/04* (2006.01)
*F41C 23/20* (2006.01)

(52) U.S. Cl.
CPC ..... *F41A 11/04* (2013.01); *F41C 23/20* (2013.01)

(58) Field of Classification Search
CPC ..... F41A 11/04; F41C 23/20
USPC ..... 42/75.02
See application file for complete search history.

(56) References Cited

U.S. PATENT DOCUMENTS 4,299,046 A * 11/1981 Atchisson ..... F41A 11/04 42/8
2015/0345895 A1* 12/2015 Young ..... F41A 3/84 42/71.01
2018/0156555 A1* 6/2018 Sessions ..... F41A 11/04
2019/0212095 A1* 7/2019 Ballard ..... F41A 11/04
2020/0200505 A1* 6/2020 Brown, Jr. ..... F41C 27/00
2021/0140738 A1* 5/2021 Lynch ..... F41C 23/22

FOREIGN PATENT DOCUMENTS

KR 20220085134 A 6/2022
RU 2056612 C1 3/1996
WO 2005083349 A1 9/2005

OTHER PUBLICATIONS

"The Smallest 22 Survival Rifle : Chiappa Little Badger TDX", published by user "sootch00" Jan. 12, 2023 (Year: 2023).*
Search Report for 202200016539 dated Feb. 16, 2023, The Hague, NL.

* cited by examiner

*Primary Examiner* — Samir Abdosh
(74) *Attorney, Agent, or Firm* — ArentFox Schiff LLP; Michael Fainberg

(57) ABSTRACT

A single-shot rifle having a barrel unit and a butt-box unit consisting of a box, a butt having a butt axis, fixed to the box, and a butt-plate fixable to the butt is provided. The barrel unit is detachable from the butt-box unit. The butt-plate is manually rotatable between a use position and a rest position and the barrel unit is laterally couplable to the butt-box unit. The single-shot rifle with separate parts is insertable into a substantially rigid tube for carrying the weapon. The tube and the single-shot rifle housed in the tube form a floating, waterproof assembly.

19 Claims, 17 Drawing Sheets fig.4a
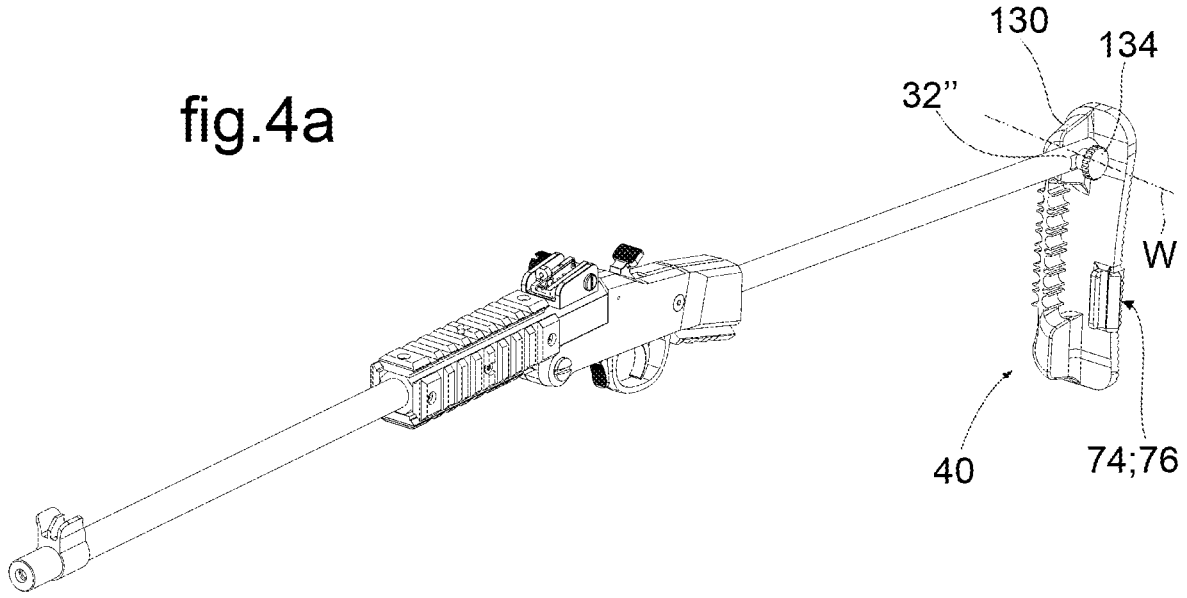
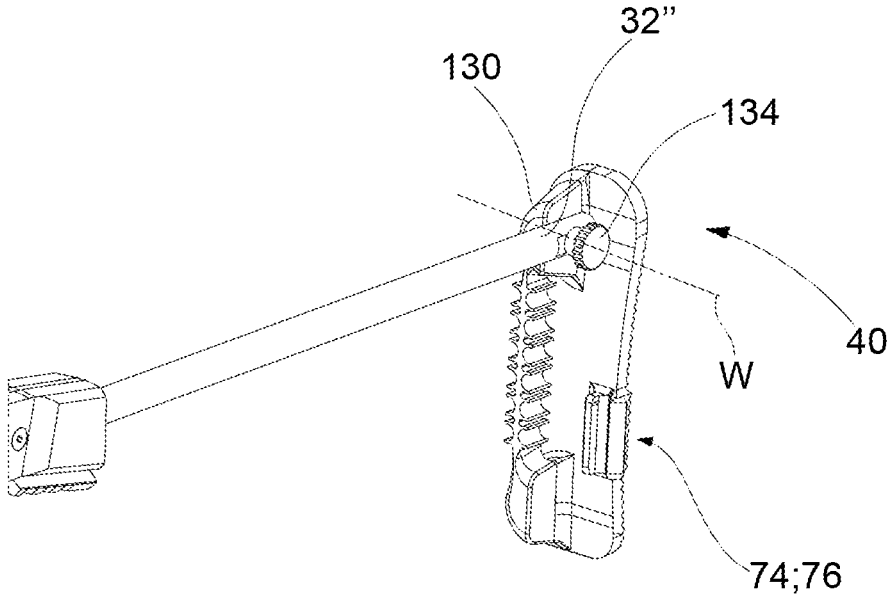
fig.4b fig.4c
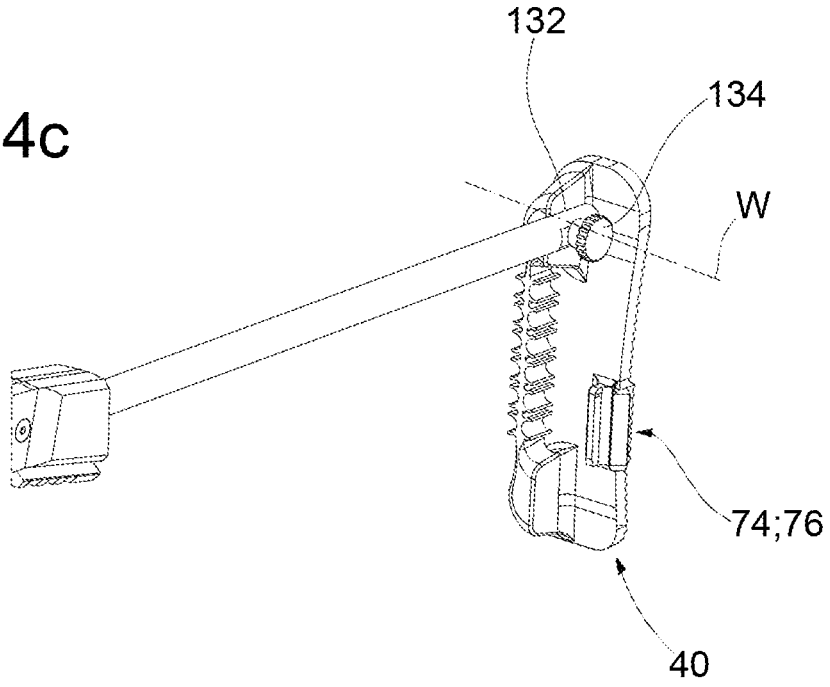
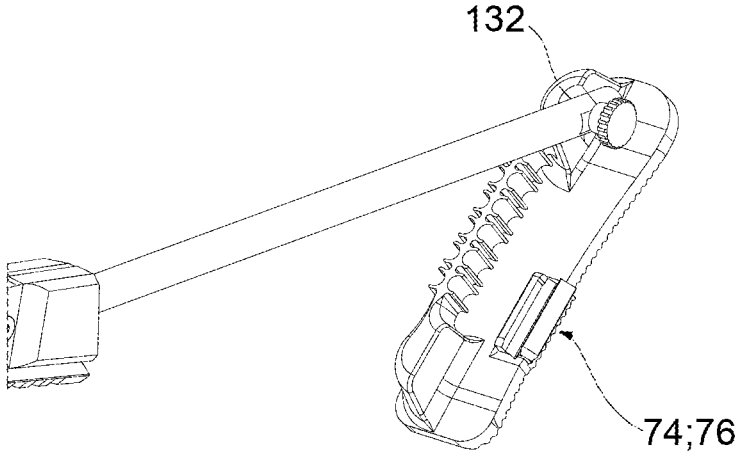
fig.4d fig.4e
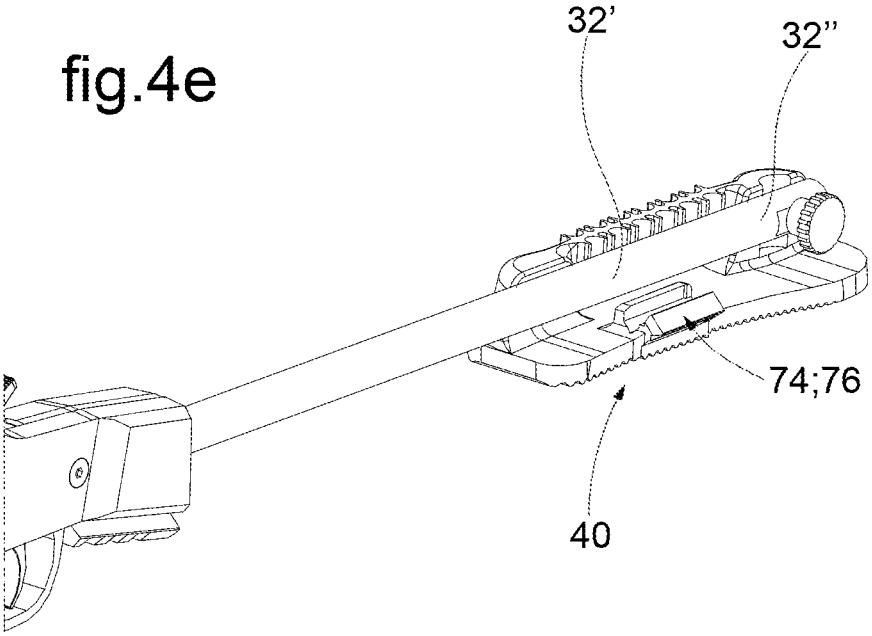
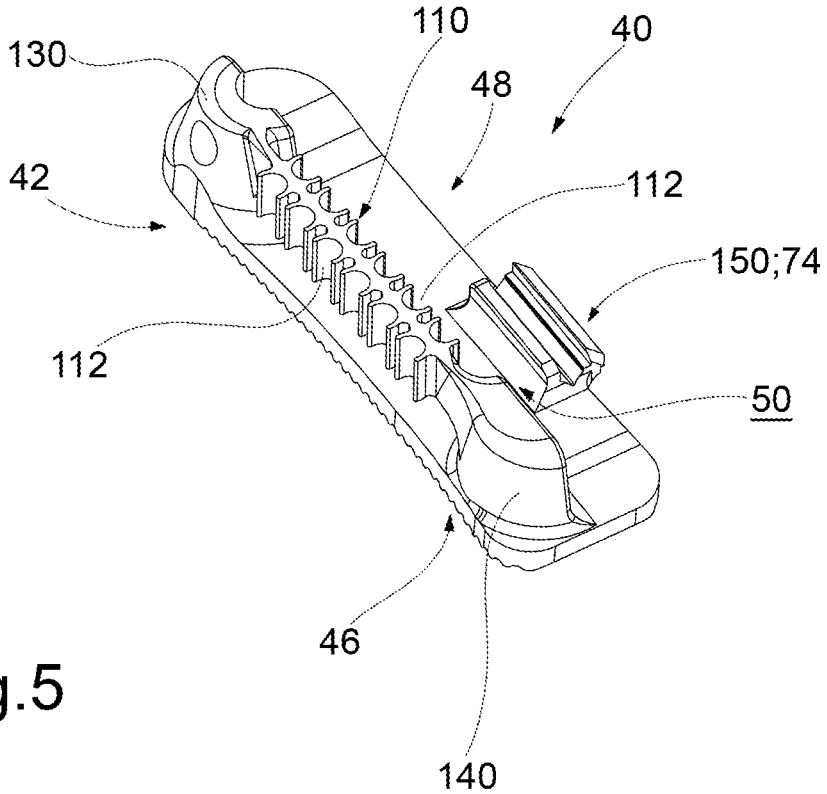
fig.5

SINGLE-SHOT RIFLE

CROSS-REFERENCE TO RELATED APPLICATION

This application claims priority to Italian Patent Application No. 102022000016539 filed on Aug. 3, 2022, the contents of which are incorporated by reference in their entirety.

FIELD OF THE INVENTION

The present invention relates to weapons for sporting or recreational activities. In particular, the present invention concerns a single-shot rifle.

BACKGROUND OF THE INVENTION

A single-shot folding rifle known as "Little Badger" (FIG. 15), produced and marketed by Chiappa Firearms S.r.l., has been known on the market for some years. It is a rifle well known to enthusiasts in this field due to its characteristic and minimalistic design, and its great manageability, weightlessness and easy use, which have made this rifle a point of reference in the field.

SUMMARY OF THE INVENTION

The Applicant has now conceived an innovative single-shot rifle, which is the subject of the present invention, capable of meeting even better the needs of weapon transportability, while keeping the features of lightness, easy assembly and use appreciated by the market unchanged.

BRIEF DESCRIPTION OF THE DRAWINGS

The features and advantages of the single-shot rifle according to the present invention will be apparent from the description below, given by way of a non-limiting example, in accordance with the accompanying drawings, in which:

FIGS. 4*a* to 4*e* show the sequence of the butt-plate arrangements from a use position to a rest position;

FIG. 5 depicts a butt-plate for a rifle, according to an embodiment of the present invention;

DETAILED DESCRIPTION

Figure 1A:
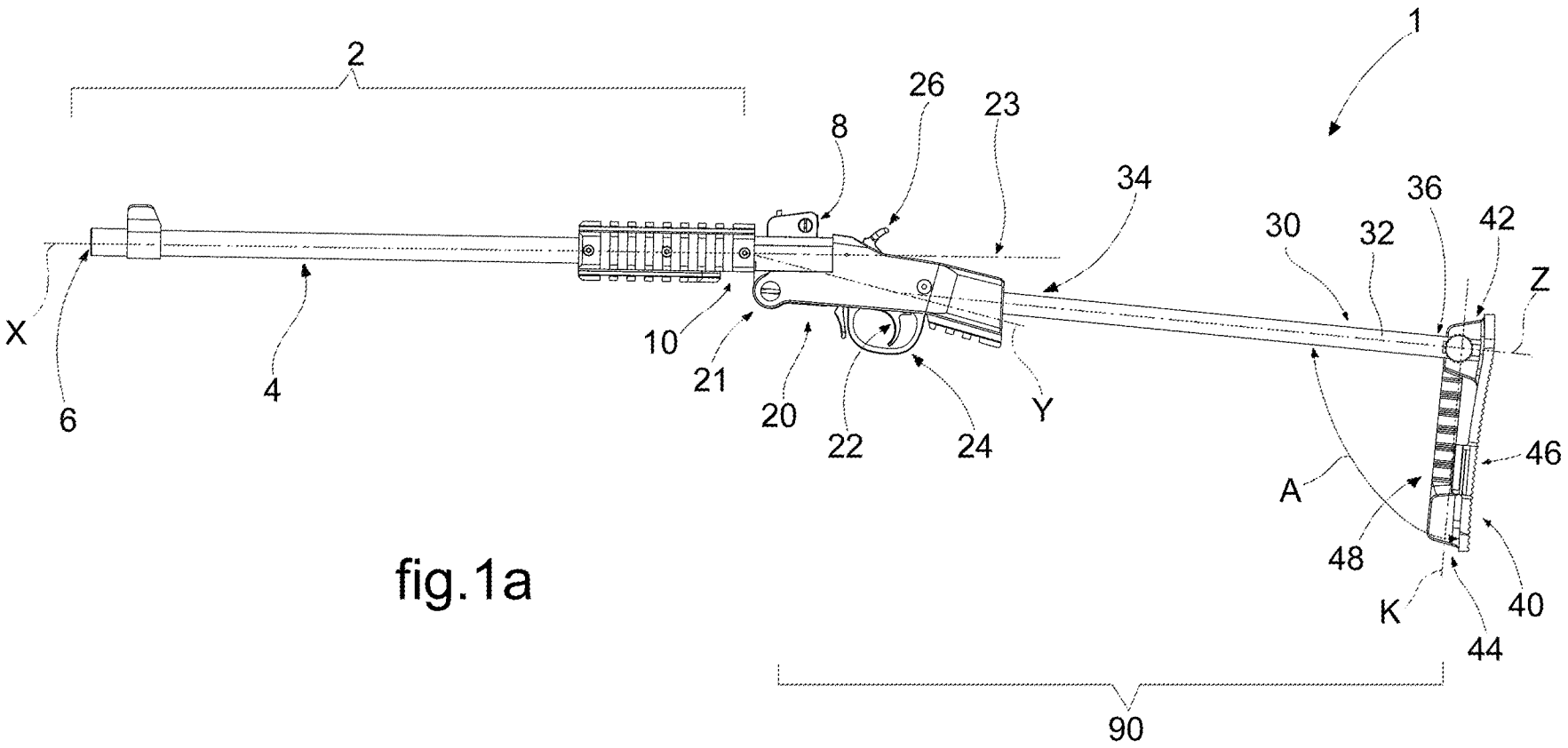
FIGS. 1*a* and 1*b* show a side view of a single-shot rifle according to an embodiment of the present invention, in a use configuration.

With reference to the figures in the accompanying drawings, a single-shot rifle according to the present invention is indicated, as a whole, by reference numeral 1.

The rifle 1 comprises a single-block barrel unit 2.

The barrel unit 2 comprises an internally hollow or ribbed single barrel 4 extending along a central barrel axis X between a front end 6, where there is the outlet mouth of the shot, and an opposite rear end 8. The barrel unit 2 further comprises a closing lock 10.

A sagittal plane Ps is defined for the rifle 1, which contains the barrel axis X and is orthogonal to a horizontal reference plane.

The rifle 1 further comprises a box 20 consisting of an internally hollow casing. The box 20 extends along a box axis Y between a front portion 21, with which the barrel unit 2 is engaged, and an opposite rear portion 23.

The rifle 1 further comprises a trigger 22, protruding at the bottom from the box 20 and protected by a bridge 24 of the box 20, an outer hammer 26, protruding at the top from the box 20 so as to cooperate with the rear end 8 of the barrel 4, and a shooting mechanism, housed in the box 20, operatively connected to the trigger 22 and the hammer 26.

The rifle 1 further comprises a butt 30 preferably consisting of a single rod 32 extending along a butt axis Z between a front end 34, fixed to the rear portion 23 of the box 20, and an opposite rear end 36. The butt axis Z lies on the sagittal plane Ps of the rifle.

The rod 32 is preferably internally hollow, i.e., it is a tubular element, e.g., with a circular section, preferably rectilinear and made of steel.

The butt axis Z of the butt 30, and in particular of the rod 32, forms, with the barrel axis X of the barrel unit 2 and in particular of the barrel 4, a main angle C (FIG. 1*b*) defined on the side of the hammer 26, preferably between 8° and 1°, more preferably between 7° and 2°, and preferably of 4° 40' with a tolerance ±2° 0'. Advantageously, the main angle C allows an optimal positioning of the rifle against the user's shoulder, so that use is comfortable and precise.

The butt 30 is preferably devoid of elements or portions or segments protruding in the sagittal plane Ps from the rod 32, in order to minimize the dimensions in a transport configuration of the rifle, which will be discussed in further detail below.

The rifle 1 further comprises a butt-plate 40, preferably made in a single piece, for example made of a polymer material or steel or light alloy, applied to the rear end 36 of the butt 30 in a manually movable manner.

The butt-plate 40 extends along a butt-plate axis K, between an engagement end 42, engageable with the rear end 36 of the butt 30, and an opposite free end 44. The butt-plate axis K lies on the sagittal plane Ps.

Moreover, the butt-plate 40 has a rear support surface 46 intended to come into contact with the user's shoulder when using the rifle, and an opposite front portion 48, in which a seat 50 is preferably obtained, e.g., a groove, extending along the butt-plate axis K, adapted to accommodate an engagement portion 32' of the butt 30, such as an engagement segment of the rod 32, for example.

The butt-plate 40 is constrained to the butt 30 in a positionable manner between a stable use position (FIG. 1*a*) in a use configuration of the butt-plate, in which the butt-plate 40 protrudes from the butt 30 in the sagittal plane Ps, so that the support surface 46 can stably rest on the user's shoulder for using the weapon, and a stable rest position (FIG. 2) in a rest configuration of the butt-plate, in which the butt-plate 40 is placed side-by-side with the butt 30 along the extension thereof, so as to reduce the size.

In other words, in the use configuration of the rifle, the butt axis Z and the butt-plate axis K form a first angle A at the front, e.g., a right angle, while in the second configuration of the rifle, they form a second angle B at the front, which is smaller than the first angle A. For example, the second angle B is zero because the butt axis Z and the butt-plate axis K are parallel.

In the rest configuration of the butt-plate, the engagement portion 32' of the butt 30 is preferably accommodated in the seat 50 of the butt-plate 40, allowing the butt-plate to come even closer to the butt 30 and reduce the dimensions.

The butt-plate 40 is preferably hinged to the butt 30 in a rotation axis W, e.g., orthogonal to the sagittal plane Ps; in particular, the engagement end 42 of the butt-plate 40 is hinged to the rear end 36 of the butt 30.

The butt-plate 40 comprises manually releasable stop means adapted to lock the butt-plate 40 in the use position.

For example, the stop means comprise a stop lock 130 of the front portion 48, provided with a stop seat 132 adapted to accommodate an end segment 32" of the butt 30 by shape coupling in the use configuration, i.e., an end segment 32" of the rod 32.

The stop means further comprise a stop pin 134 which crosses the end segment 32" of the butt 30 and is screwable to the stop lock 130 of the butt-plate 40.

In the use configuration, the end segment 32" of the butt 30 is accommodated in the stop seat 132 and the stop pin 134, which engages the end section 32" by crossing it, is screwed to the stop lock 130.

In order to unlock the butt-plate 40 and allow the rotation thereof, the stop pin 134 is unscrewed by the user (FIG. 4*b*) and the end segment 32" is extracted from the stop seat 132 (FIG. 4*c*); the butt-plate 40 is then rotated (FIG. 4*d*) until it reaches the rest position (FIG. 4*e*) in which the engagement portion 32' of the butt 30 is accommodated in the seat 50 of the butt-plate 40, e.g., by snap coupling.

For example, the seat 50 of the engagement portion 32' of the butt 30 is formed between the stop lock 130 at the engagement end 42 of the butt-plate 40 and a distal lock 140 of the front portion 48 of the butt-plate 40 at the free end 44, on one side of the sagittal plane Ps, and a counter-lock 150 of the front portion 48 of the butt-plate 40, on the other side of the sagittal plane Ps (FIG. 5).

Moreover, the butt-plate 40 preferably comprises a shot store 110, for example on the front portion 48, consisting of a plurality of shot seats 112, e.g., opposing each other and in two parallel rows, arranged outside the sagittal plane Ps or the butt-plate axis K, i.e., placed side-by-side with the seat 50, so as not to interfere with the engagement portion 32' of the butt 30 in the rest configuration of the butt-plate.

For example, the butt-plate 40 comprises a rib 120 of the front portion 48, shaped to form said shot seats 112. For example, the rib 120 is placed between the stop lock 130 and the distal lock 140 of the butt-plate 40 (FIG. 5).

Figure 6:
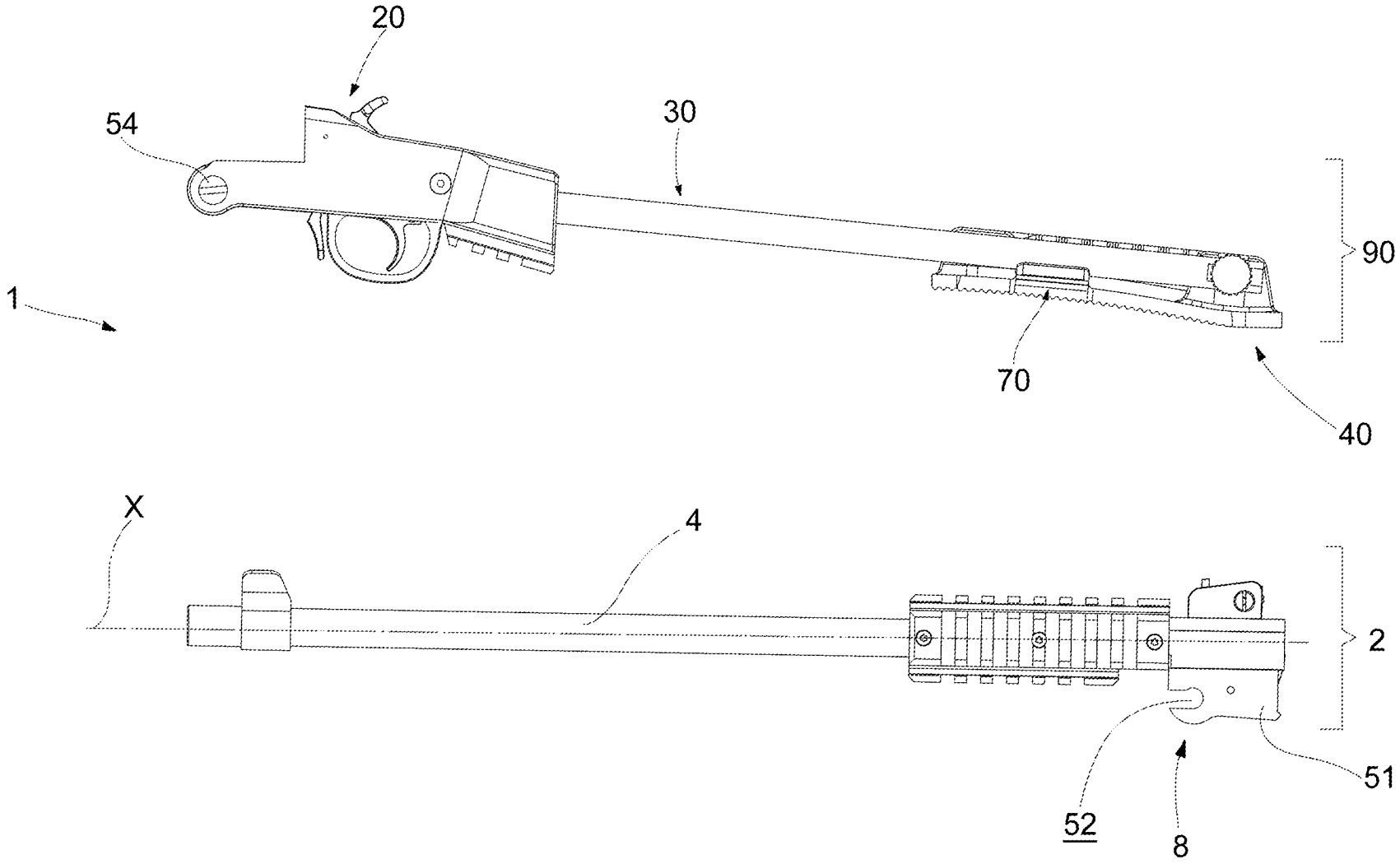
FIG. 6 shows the rifle in a configuration with separate parts.

The box 20 is fixed to the butt 30 and the butt-plate 40 is constrained to the butt 30, so that box 20, butt 30 and butt-plate 40 form a butt-box unit 90. The barrel unit 2 is detachable from the butt-box unit 90. In particular, the barrel unit 2 is detachable from the box 20 (FIG. 6). In other words, in a third configuration of the rifle or a configuration with separate parts, the barrel unit is separate from the box.

To this end, the rifle 1 comprises manually releasable axial coupling means adapted to stably couple the barrel unit to the box.

The axial coupling means preferably comprise a coupling 51 arranged at the rear end 8 of the barrel unit 2, provided with a coupling compartment 52. The coupling compartment 52 consists of a coupling passage 54 and a coupling seat 56, accessible from the outside through the coupling passage 54, which is narrow as compared to the coupling seat 56. The coupling passage 54 is open towards the front end 6 of the barrel 4.

The axial coupling means further comprise a rotatable handle 58, preferably arranged at the front portion 21 of the box 20, externally on one side thereof, so as to be manually maneuvered.

The axial coupling means further comprise a shaped coupling pin 60, rotationally integral with the handle 58 and coaxial thereto, placed inside the box 20. For example, the coupling pin 60 has a leveling 61.

Figure 7:
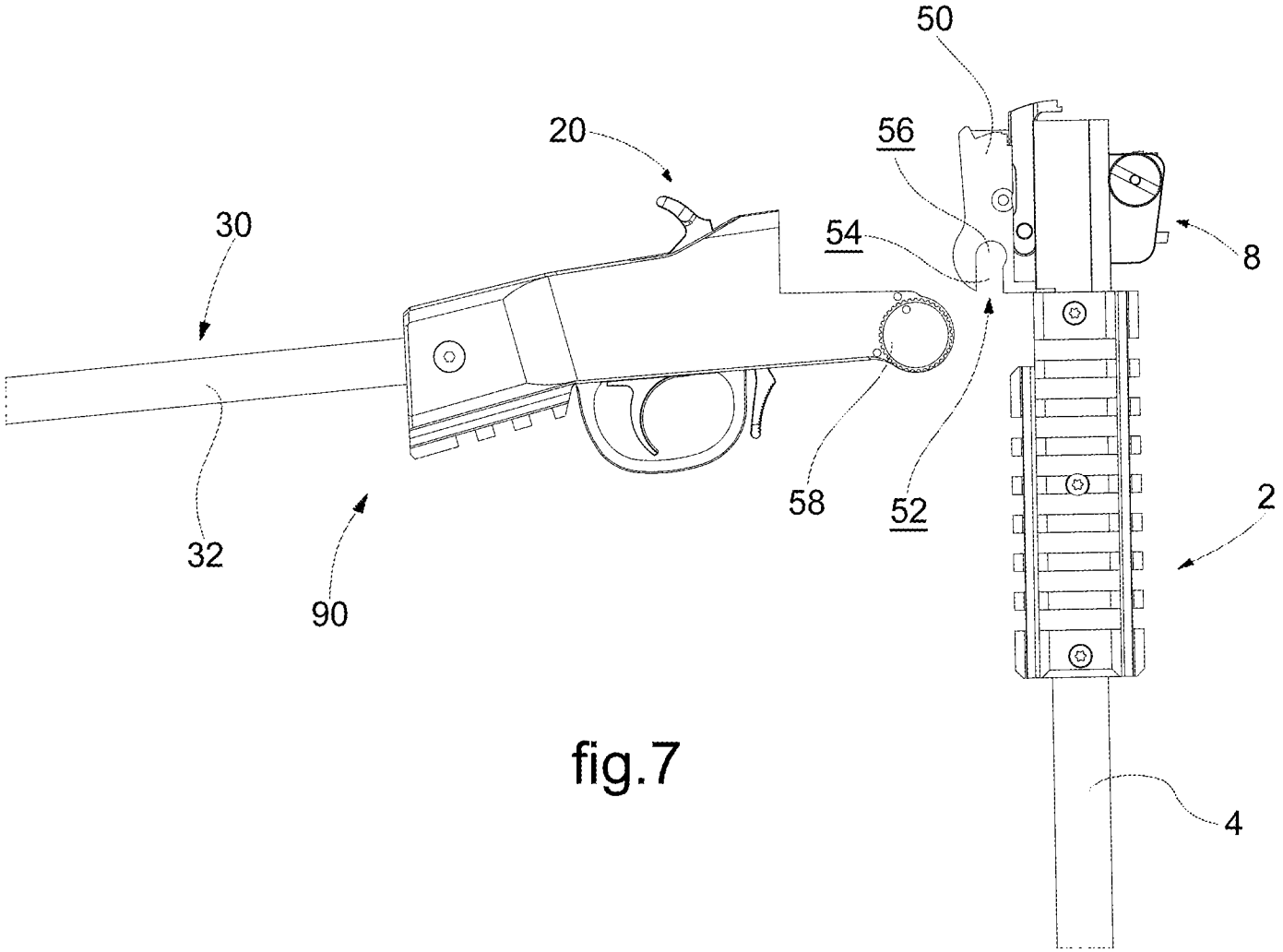
FIGS. 7 to 10 depict the axial coupling sequence of a barrel unit to a butt-box unit of the rifle.
Figure 8:
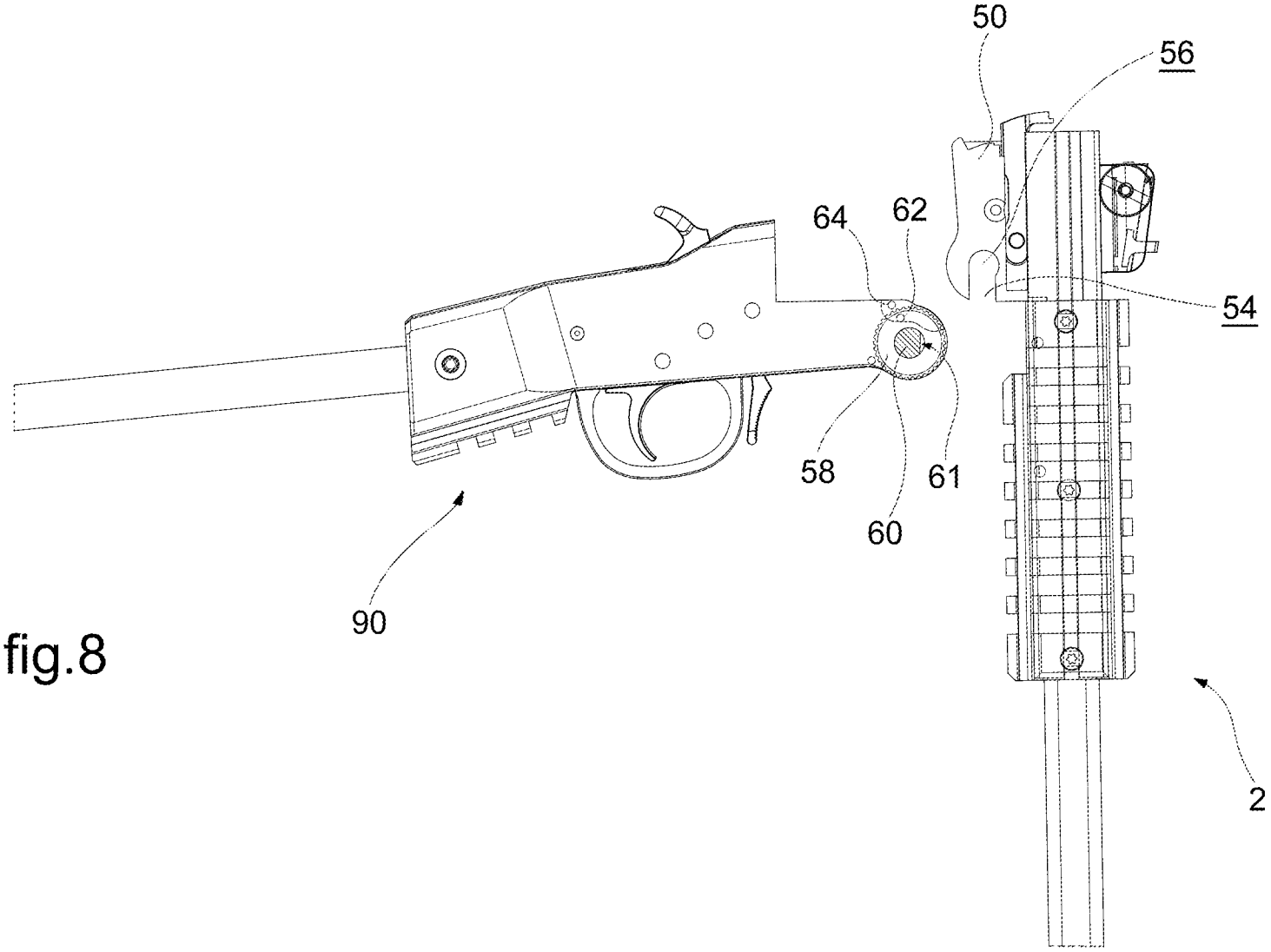
Figure 9:
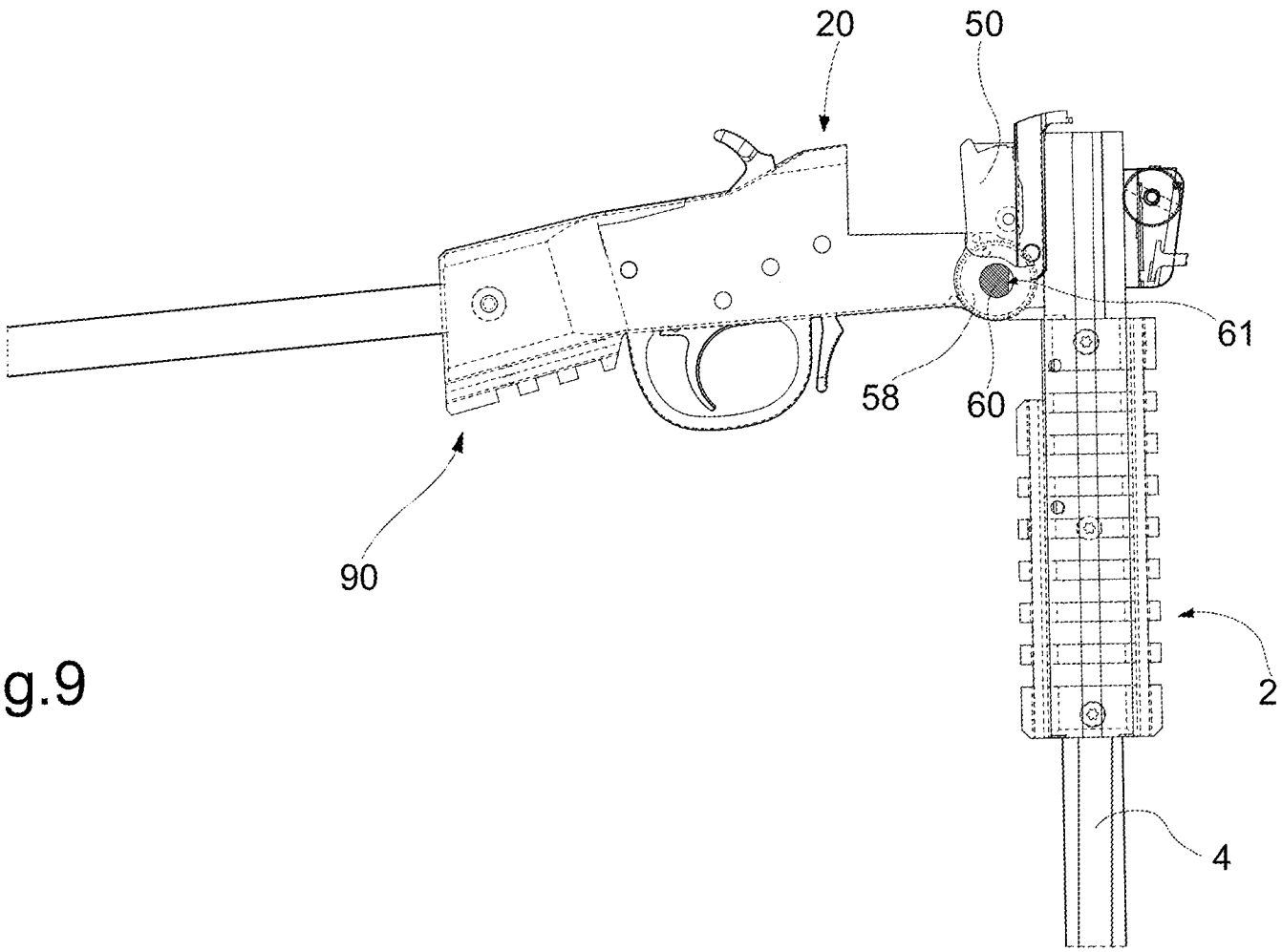

In a first position of the handle (FIGS. 7 and 8), preferably corresponding to the alignment between a handle index 62 placed on the handle 58 and an opening index 64 placed on the box 20, the coupling pin 60 is in an opening position allowing the engagement of the barrel unit 2, i.e., allowing the coupling pin 60 to be inserted into the coupling seat 56, because, by virtue of the leveling 61, passage of the section of the pin through the coupling passage 54 and thus accommodation in the coupling seat 56 are allowed (FIG. 9).

Once the handle 58 has been rotated by the user to a second position (FIG. 10), preferably corresponding to the alignment between the handle index 62 placed on the handle 58 and a closing index 66 placed on the box 20, the coupling pin 60 is in a closing position which prevents it from coming out of the coupling seat 56 because the dimension of the unleveled section of the pin prevents the passage through the coupling passage 54.

In other words, the axial coupling means comprise the coupling compartment 52 of the barrel unit 2, consisting of the coupling passage 54 and the coupling seat 56, accessible from the outside through the coupling passage 54, which is narrow as compared to the coupling seat 56, and the shaped coupling pin 60, inside the box 20, which is rotatable and insertable, in a first predefined angular position, into the coupling passage 54 and trapped in the coupling seat 56 in a second predefined angular position.

Figure 1B:
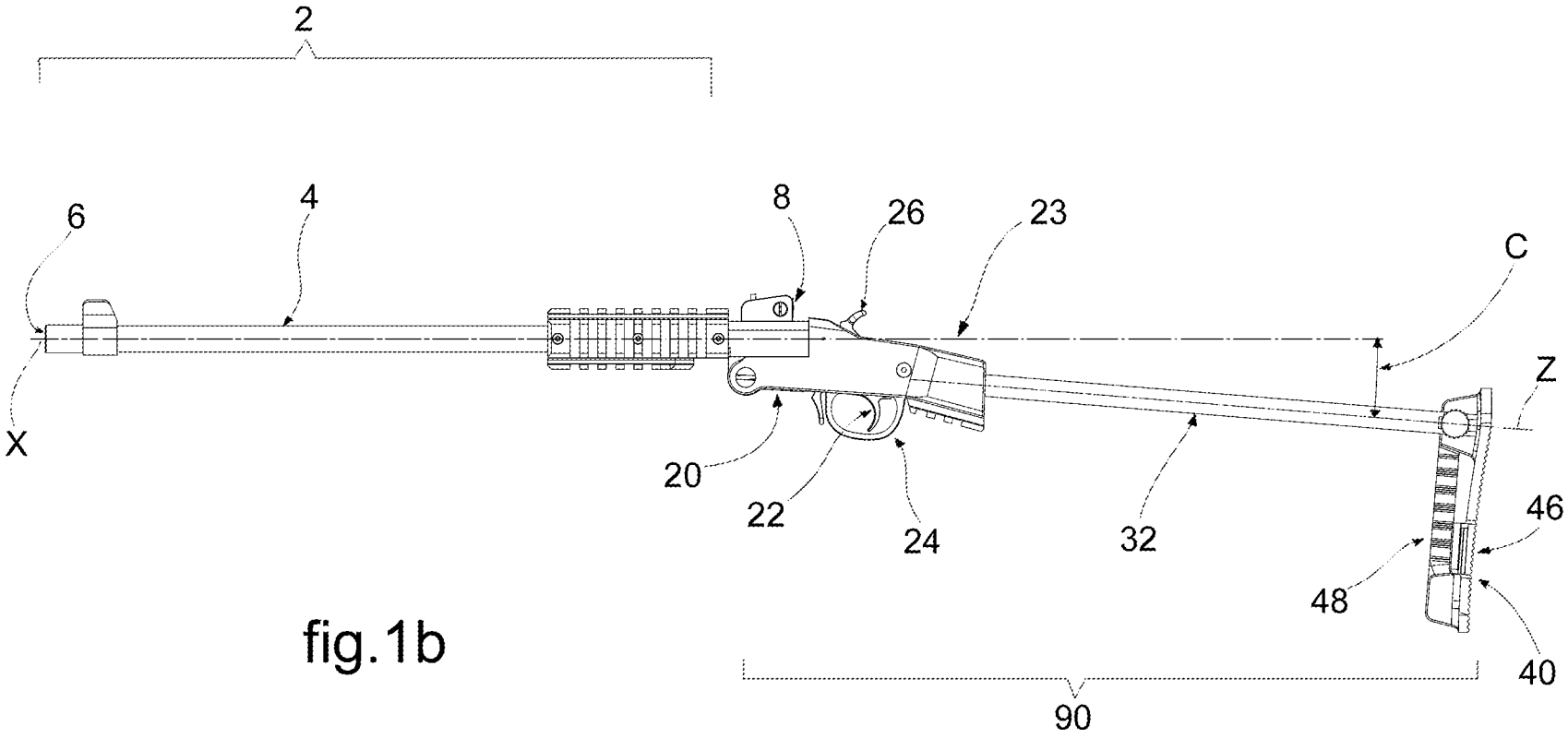
Figure 2:
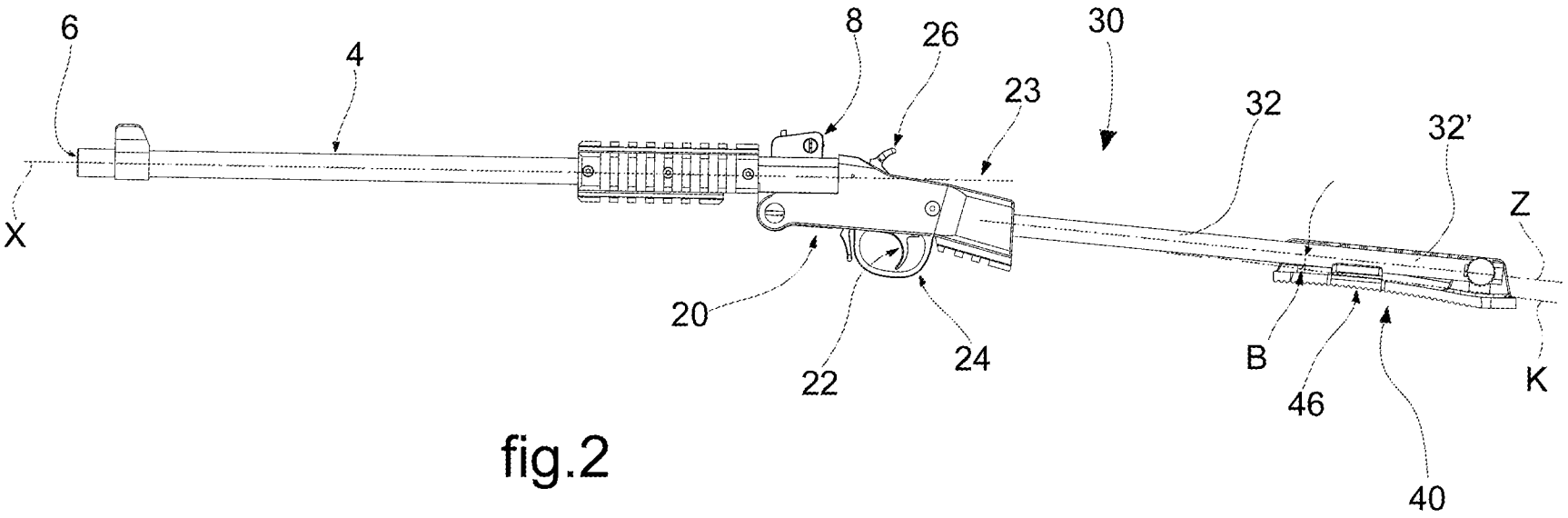
FIG. 2 depicts the rifle in FIG. 1*a*, in which a butt-plate is in a rest configuration.
Figure 3:
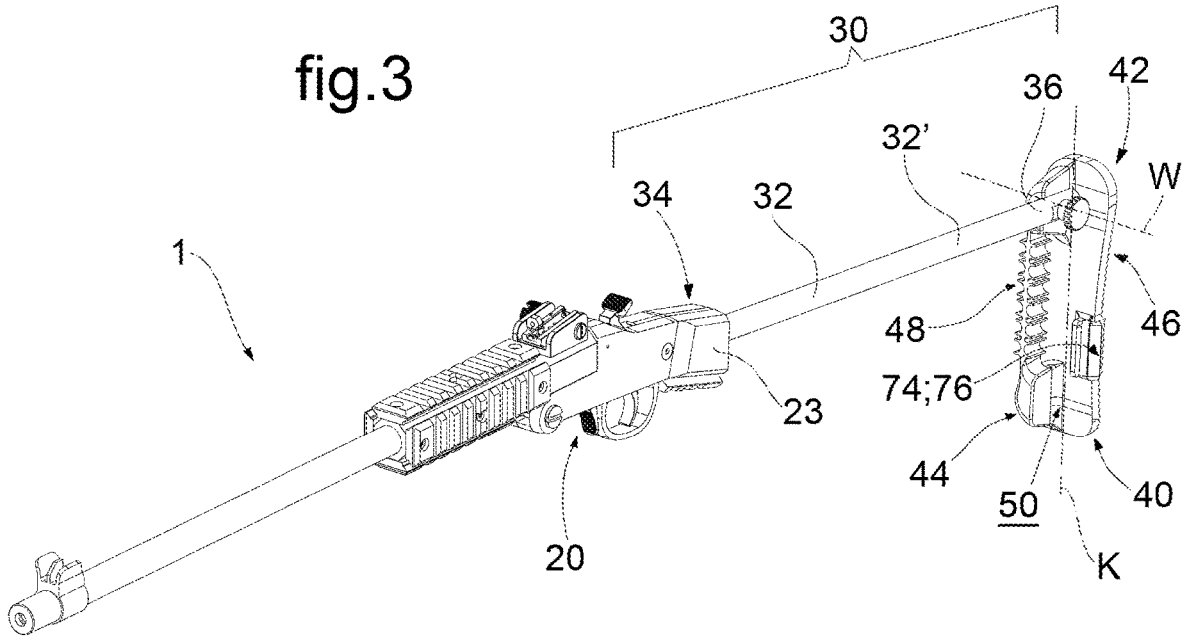
FIGS. 3, 3*a* and 3*b* are further images of the rifle, highlighting the features of the butt-plate.
Figure 3A:
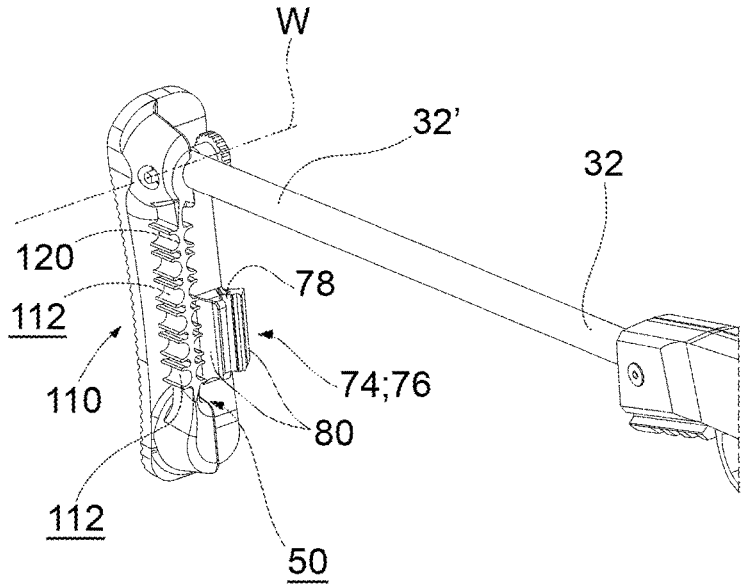
Figure 3B:
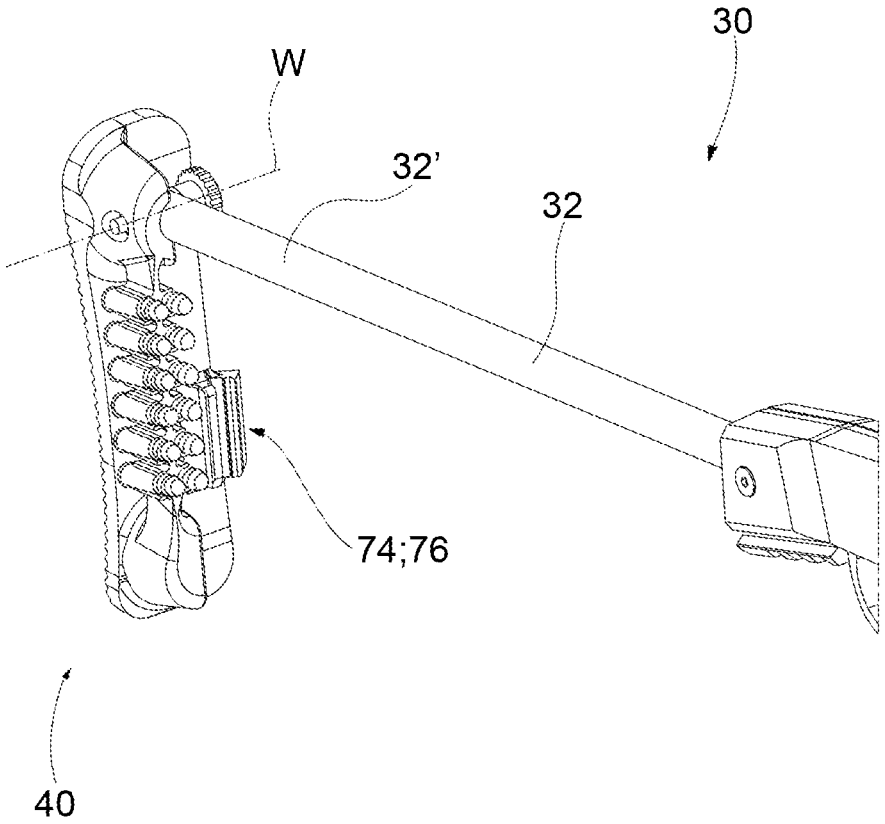
Figure 10:
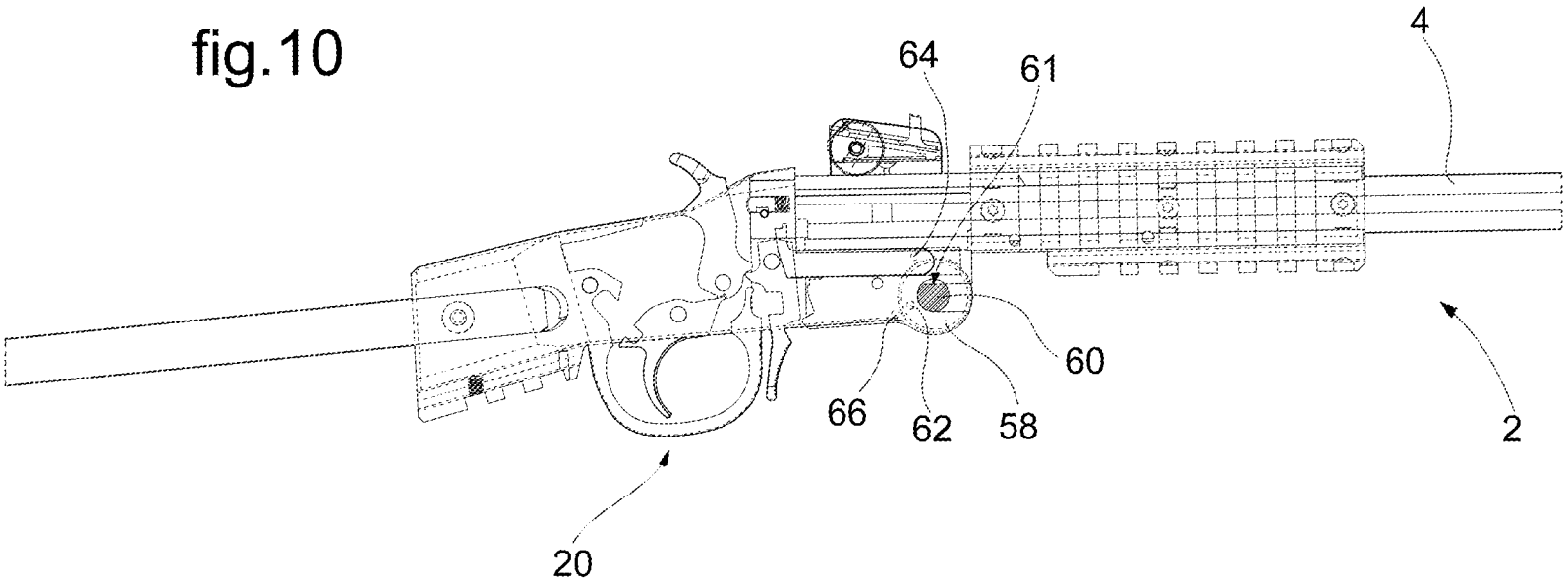

The barrel unit 2 is rotatable with respect to the connection pin 60 both before and after the rotation of the handle, thus achieving a closing configuration of the rifle (FIG. 10). In a use configuration of the rifle, the rifle is in the closing configuration and the butt-plate is in the use configuration (FIG. 1*a*).

Figure 11:
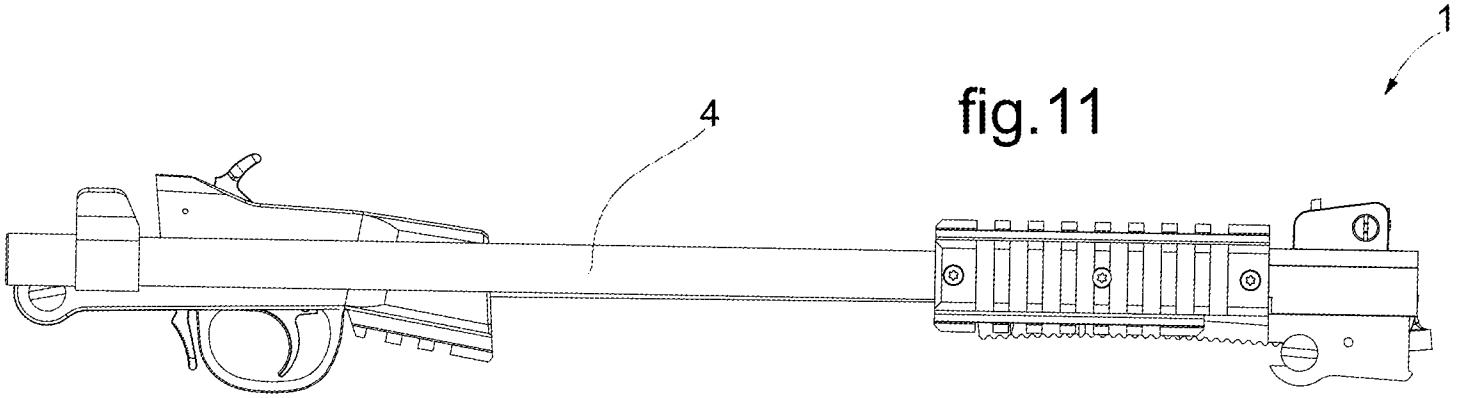
FIGS. 11 and 12 show the rifle in a transport configuration.
Figure 12:
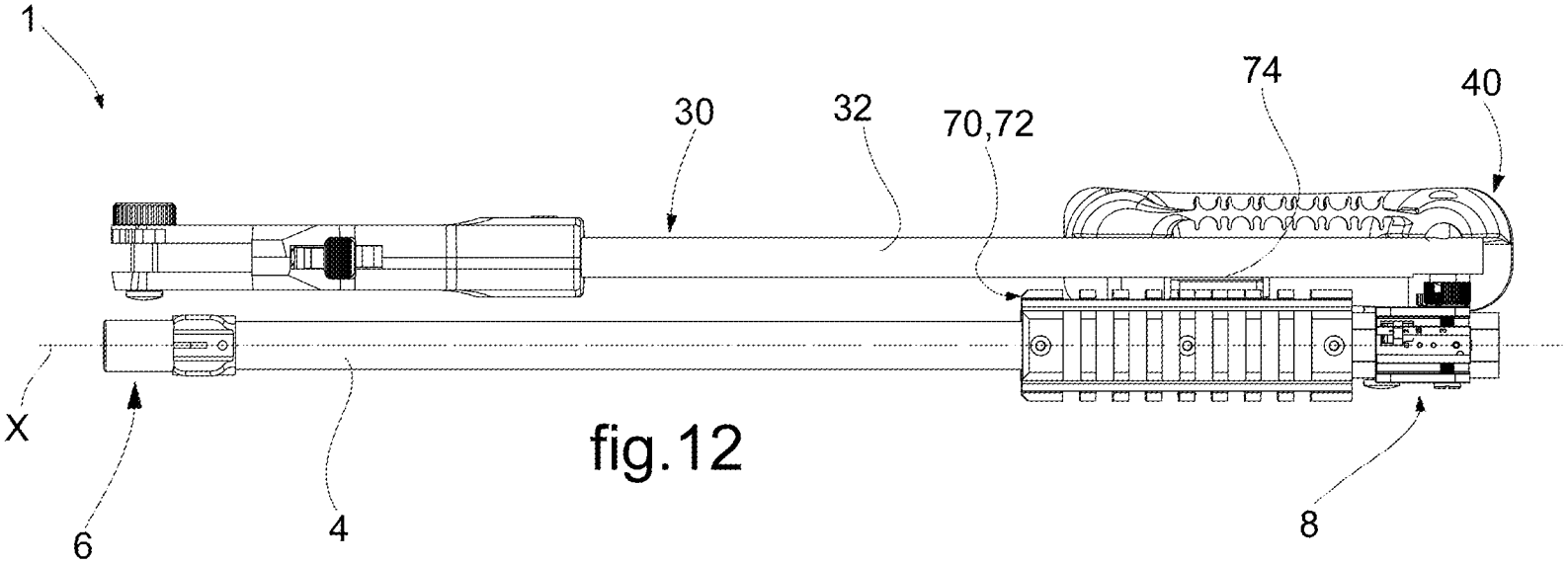
Figure 13:
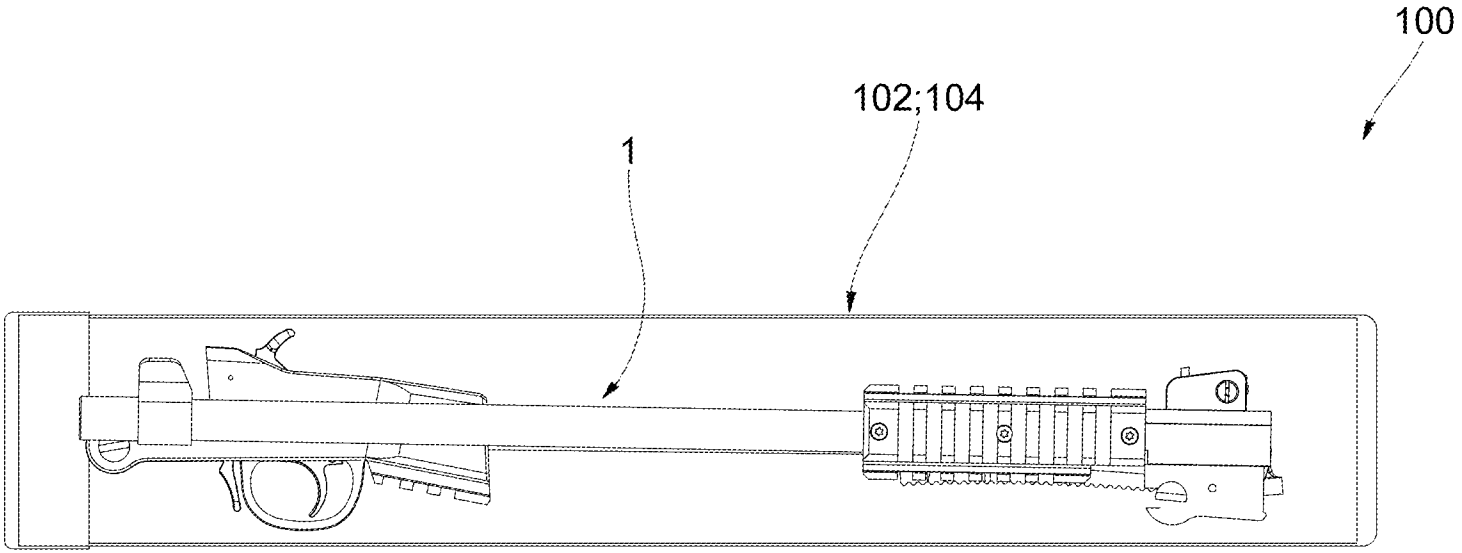
FIG. 13 depicts a transport assembly.
Figure 14:
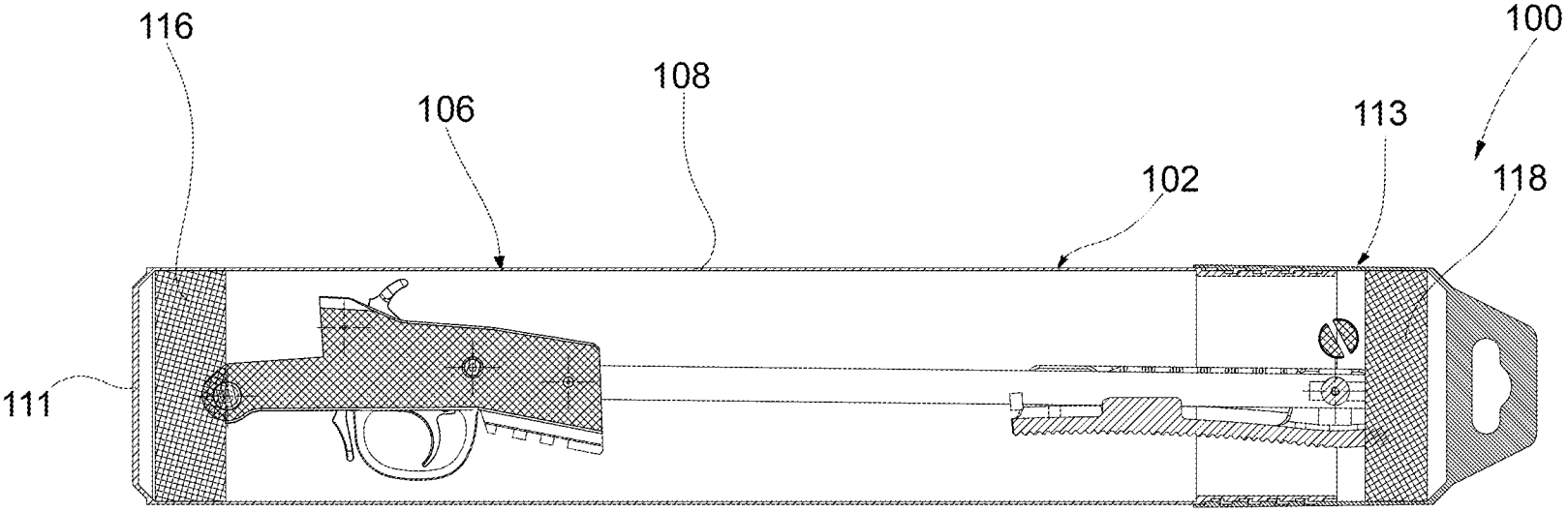
FIG. 14 is a sectional view of the transport assembly in FIG. 13.
Figure 15:
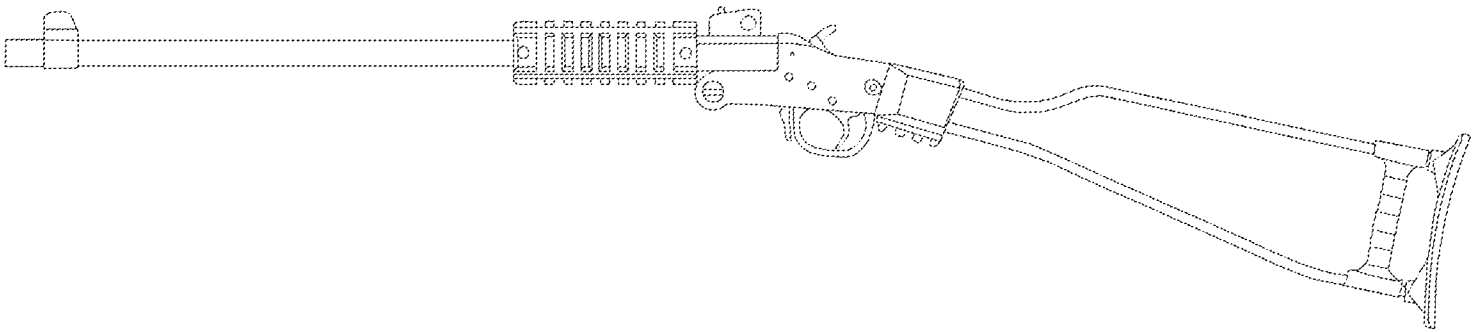
fig.15 (PRIOR ART)
FIG. 15 is a side view of the single-shot rifle known as "Little Badger", produced and marketed by Chiappa Firearms S.r.l., belonging to the prior art.

From the configuration with separate parts of the rifle, the barrel unit 2 is laterally releasably couplable to the butt-box unit 90 (FIGS. 11 and 12). In other words, in a configuration with coupled parts, the barrel unit 2 is laterally stably coupled to the butt-box unit 90. To this end, the rifle 1 comprises lateral coupling means adapted to mutually laterally couple the barrel unit to the butt-box unit in a releasable manner.

According to a preferred embodiment, the barrel unit 2 is laterally couplable to the butt-plate 40 of the butt-box unit 90, in particular when the butt-plate is in the rest position.

The lateral coupling means preferably comprise a first lock 70 integral with the barrel unit 2, preferably at the rear end 8 of the barrel unit 2; for example, the first lock 70 consists of a Picatinny guide 72 applied to the barrel unit 2.

The rifle 1 preferably comprises four Picatinny guides, arranged at the rear end 8 of the barrel unit 2, arranged orthogonally to one another about the barrel 4.

Moreover, the coupling means comprise a second lock 74 integral with the butt-plate 40, e.g., arranged in an intermediate position between the engagement end 42 and the free end 44, adapted to make a shape coupling with the first lock 70 for laterally coupling the barrel unit 2 to the butt-plate 40.

For example, the second lock 74 consists of the counter-lock 150 for the seat 50 of the engagement portion 32' of the butt 30.

The second lock 74 preferably consists of a counter-guide 76, provided with a base 78 and folded side walls 80, for example, which is adapted to slidingly accommodate the Picatinny guide 72 for making the coupling. The counter-guide 76 is preferably configured to accommodate the Picatinny guide 72 for axially sliding parallel to the butt-plate axis K, so that in the configuration with coupled parts, the barrel axis X and the butt axis Z are arranged substantially parallel.

In a transport configuration (FIG. 12), the barrel unit 2 is laterally coupled to the butt-box unit 90 and the butt-plate is in the rest configuration. In such a configuration, the size of the rifle is minimal.

In general, the lateral coupling means are suitable, from a configuration with separate parts of the rifle in which the barrel unit 2 is detached from the butt-box unit 90, for mutually laterally coupling the barrel unit 2 to the butt-box unit 90 in a releasable manner, even in mutual positions other than that depicted in FIG. 12. In particular, the lateral coupling is such that the barrel 4 is placed side-by-side with the rod 32, and in particular the barrel axis X is parallel to the butt axis Z.

A transport assembly 100 comprises a substantially rigid casing 102, e.g., consisting of a tubular box 104, for example made of a plastic material, and the rifle 1, in the transport configuration. For example, the transport assembly 100 comprises straps or belts connected to the casing 102 for carrying the transport assembly over the shoulder.

The transport assembly 100 is preferably floating and the casing 102 is at least watertight, i.e., it does not allow the infiltration of water from the outside. Advantageously, this allows the user to cross rivers or canals, e.g., by swimming with the transport assembly over his/her shoulder, without worrying about water entering in the casing and damaging the rifle.

To this end, the casing 102 comprises a casing body 106 comprising a cylindrical side wall 108 and a casing bottom 111 closing the side wall 108 at one end. The casing bottom 111 is made in a single piece with the side wall 108 or sealingly applied thereto.

The casing 102 further comprises a cap 113 sealingly applicable to the other end of the side wall 108, e.g., by pressure, and separable therefrom for storing the rifle 1 therein or extracting it.

Moreover, the transport assembly 100 preferably comprises a first deformable support element 116, e.g., a sponge, inserted into the casing 102 at the end of the casing bottom 111, for supporting one end of the rifle, and a second deformable support element 118, e.g., a sponge, inserted into the cap 113 for supporting the other end of the rifle. The support elements 116, 118 allow keeping the rifle in place inside the casing, avoiding continuous movements and impacts.

According to a variation of the invention, the butt-plate is separable from the butt and storable in the casing along with the barrel unit and the butt-box unit for transport.

According to a further variation of the invention, the barrel unit and the butt-box unit are stored separately in the casing. In such a variation, for example, the rifle is devoid of lateral coupling means.

According to an even further variation, the barrel unit is laterally couplable to the butt-box unit by means of a counter-guide integral with the box. In such a variation, for example, the butt-plate is devoid of the counter-guide.

Innovatively, the single-shot rifle described above meets the aforesaid needs because the weapon has highly small dimensions in the transport configuration. Advantageously, in such a configuration, the weapon can be kept in a rigid tube and carried comfortably and safely, e.g., for excursions, trips or shooting competitions.

It is apparent that, in order to meet contingent needs, those skilled in the art may make changes to the above-described rifle, all contained within the scope of protection as defined by the following claims.

What is claimed is:

1. A transport assembly for a single-shot rifle, comprising:

a barrel unit for the single-shot rifle, consisting of a barrel having an extension along a central barrel axis lying on a sagittal plane, and a closing lock;

a butt-box unit for the single-shot rifle, consisting of a box, a butt having a butt axis, fixed to the box, and a butt-plate fixable to the butt, wherein the barrel unit is axially couplable to the butt-box unit to form said single-shot rifle;

a casing containing the barrel unit and the butt-box unit, which are axially uncoupled;

wherein said transport assembly is floating and the casing is at least watertight, and wherein, alternatively:

the butt-plate, contained in the casing, is fixed to the butt in a rest position in which the butt-plate is placed side-by-side with the butt along the butt axis; or the butt-plate, contained in the casing, is separate from the butt.

2. The transport assembly of claim 1, wherein the casing comprises:

a casing body comprising a cylindrical side wall and a casing bottom closing the cylindrical side wall at one end; and a cap sealingly applicable to the other end of the cylindrical side wall, separable therefrom for storing the single-shot rifle therein or extracting the single-shot rifle.

3. The transport assembly of claim 1, wherein the casing body is tubular.

4. The transport assembly of claim 1, further comprising at least one deformable support element, inserted into the casing, for supporting the single-shot rifle and keeping the single-shot rifle in place.

5. The transport assembly of claim 1, wherein the butt-plate, comprising a support surface, is manually positionable between a use position and a rest position in which the butt-plate is placed side-by-side with the butt along the butt axis;

the barrel unit and the butt-box unit comprise lateral coupling means adapted to mutually laterally couple the barrel unit to the butt box unit in a releasable manner; and wherein the barrel unit is laterally coupled to the butt-box unit by said lateral coupling means.

6. A single-shot rifle, comprising: a barrel unit consisting of a barrel having an extension along a central barrel axis lying on a sagittal plane, and a closing lock; and a butt-box unit consisting of a box, a butt having a butt axis, fixed to the box, and a butt-plate fixable to the butt, wherein the barrel unit is detachable from the butt-box unit;

the butt-plate, comprising a support surface, is manually positionable between a use position and a rest position in which the butt-plate is placed side-by-side with the butt along the butt axis; and the single-shot rifle further comprises lateral coupling means suitable, from a configuration with separate parts of the single-shot rifle in which the barrel unit is detached from the butt-box unit, for mutually laterally coupling the barrel unit to the butt-box unit in a releasable manner.

7. The single-shot rifle of claim 6, wherein the lateral coupling means are adapted to laterally couple the barrel unit to the butt-plate of the butt-box unit.

8. The single-shot rifle of claim 7, wherein the lateral coupling means comprise a first lock integral with the barrel unit consisting of a Picatinny guide.

9. The single-shot rifle of claim 8, wherein the lateral coupling means comprise a second lock integral with the butt-plate.

10. The single-shot rifle of claim 9, wherein said second lock is adapted to create a shape-coupling with the Picatinny guide for axially sliding parallel to the butt-plate axis.

11. The single-shot rifle of claim 6, wherein the butt-plate is hinged to the butt in a rotation axis and comprises manually releasable stop means adapted to lock the butt-plate in the use position.

12. The single-shot rifle of claim 11, wherein the manually releasable stop means comprise:

a stop lock of the butt-plate, provided with a stop seat adapted to accommodate an end segment of the butt by shape-coupling in the use position of the butt-plate; and a stop pin that crosses the end segment of the butt and is screwable to the stop lock of the butt-plate.

13. The single-shot rifle of claim 6, further comprising manually releasable axial coupling means adapted to couple the barrel unit to the box.

14. The single-shot rifle of claim 13, wherein the manually releasable axial coupling means comprise:

a coupling compartment of the barrel unit, consisting of a coupling passage and a coupling seat, accessible from outside through the coupling passage, which is narrow compared to the coupling seat; and a shaped coupling pin, inside the box, which is rotatable and insertable, in a first predefined angular position, into the coupling passage and trapped in the coupling seat in a second predefined angular position.

15. The single-shot rifle of claim 6, wherein the butt comprises a rod and is devoid of elements or portions or segments protruding in the sagittal plane from the rod.

16. The single-shot rifle of claim 15, wherein the rod is single and the butt axis lies on the sagittal plane.

17. The single-shot rifle of claim 6, wherein the butt-plate comprises a seat for accommodating an engagement portion of the butt, when the butt-plate is in the rest position.

18. The single-shot rifle of claim 6, wherein the butt-plate comprises a shot store, outside the sagittal plane.

19. A transport assembly, comprising:

a single-shot rifle according to claim 6, in a transport configuration in which the barrel unit is laterally coupled to the butt-box unit and the butt-plate is in the rest configuration; and a casing in which said single-shot rifle is contained.

* * * * *